US006595409B2

(12) United States Patent
Hashimoto et al.

(10) Patent No.: US 6,595,409 B2
(45) Date of Patent: Jul. 22, 2003

(54) PAPER CONTAINER AND METHOD OF MANUFACTURING IT

(75) Inventors: Masaru Hashimoto, Maebashi (JP); Yasuhiro Ohara, Maebashi (JP)

(73) Assignee: Kuramae Sangyo Co., Ltd., MaeBashi (JP)

( * ) Notice: Subject to any disclaimer, the term of this patent is extended or adjusted under 35 U.S.C. 154(b) by 0 days.

(21) Appl. No.: 09/835,629

(22) Filed: Apr. 17, 2001

(65) Prior Publication Data

US 2002/0038816 A1 Apr. 4, 2002

(30) Foreign Application Priority Data

Apr. 18, 2000 (JP) ..... 2000-116819

(51) Int. Cl.[7] ..... B65D 3/06; B65D 3/22

(52) U.S. Cl. ..... 229/108; 229/4.5; 229/400; 493/153; 493/158

(58) Field of Search ..... 229/4.5, 108, 400; 493/152, 153, 154, 155, 158, 159

(56) References Cited

U.S. PATENT DOCUMENTS

| | | | | | |
|---|---|---|---|---|---|
| 1,074,008 | A | * | 9/1913 | Nagel | 229/400 |
| 1,308,793 | A | * | 7/1919 | Luellen | 229/4.5 |
| 1,799,357 | A | * | 4/1931 | Davis | 493/152 |
| 2,131,438 | A | * | 9/1938 | Jensen | 493/152 |
| 2,240,045 | A | * | 4/1941 | Mackenzie | 229/400 |
| 2,304,278 | A | * | 12/1942 | Poster | 229/400 |
| 2,489,507 | A | * | 11/1949 | Shapiro et al. | 493/159 |
| 3,904,089 | A | * | 9/1975 | Demagny | 493/154 |
| 6,237,845 | B1 | | 5/2001 | Hashimoto et al. | |

FOREIGN PATENT DOCUMENTS

| | | | | |
|---|---|---|---|---|
| DE | 295 16 824 U1 | | 10/1995 | |
| FR | 2 778 324 | | 5/1998 | |
| JP | 1-226549 A | * | 9/1989 | 229/400 |
| JP | 2000-309326 | | 4/1999 | |

* cited by examiner

*Primary Examiner*—Gary E. Elkins
(74) *Attorney, Agent, or Firm*—Armstrong, Westerman & Hattori, LLP

(57) ABSTRACT

A method is provided of calculating a development plan of a paper container of deep bottom integrally formed from a single-sheet blank. An annular rule line 6 constituting a regular polygonal shape is formed at the center of a single-sheet blank to constitute the bottom face of the paper container, and divided faces 5 to constitute the outside of the peripheral face of the paper container are formed on the outside of the annular rule line 6. The blank portions between the divided faces 5 constitute inner pleated faces 4. Each of the blank portions is folded downwards along the rule line 7 and folded upwards along the line 9, so that the blank portion is folded to define two triangles 8 with an angle $\phi$ and the overlapping portions thus obtained constitute an inner wall face 4. The lateral edges of the divided faces 5 are brought together by folding up the annular rule line 6 while folding the inner pleated faces 4 in two along the lines of symmetry 7 and 9, and the inner pleated faces are overlapped onto the divided faces, whereby a paper container is manufactured.

5 Claims, 9 Drawing Sheets

(a)

PAPER CONTAINER AND METHOD OF MANUFACTURING IT

BACKGROUND OF THE INVENTION

1. Field of the Invention

The present invention relates to a paper container and method of manufacturing it that is used as a container for food products or plant pot etc. In more detail, it relates to a paper container and method of manufacturing it having a deep bottom and formed by folding a single-sheet blank.

2. Description of the Related Art

Conventionally, for the distribution of food products etc., plastic containers, which are easily molded, are frequently used. However, recently, on account of problems concerning elution of environmental hormones or disposal processing after use, the use of paper containers is being re-evaluated. As methods of manufacturing paper containers, the method of sticking together and the papermaking method etc. are well known. In the former i.e. the sticking-together method, for example raw-material paper sheets that have been subjected to laminating processing are employed to separately mould blanks which are used for forming the trunk and the bottom of the container; these two are then united by hot pressure fixing in a metal mold.

In the latter i.e. the paper-making method, the paper fibers are dispersed in water and the basic shape of the container is produced by filtering this colloidal solution using a paper-making mesh of prescribed shape and dewatering; the paper container is then manufactured by hot pressing or by drying this using a current of hot air. These methods had the drawbacks that the number of steps necessary was large, making them costly, and that the containers obtained had little resistance to water and so could not be employed for containers that need to be waterproof, such as containers for drinks or plant pots.

Also, the drawing method of integrally forming a paper container from a single-sheet blank is conventionally known and is commonly employed. With this drawing method, waterproof containers can be manufactured efficiently and at low cost by for example using blanks that have been subjected to laminating processing.

This drawing method has the advantage that a waterproof product can be produced comparatively easily with a small number of steps, since it is integrally formed from a single-sheet blank. However, setting the conditions for the processing is extraordinarily difficult and in particular there was the difficulty that the blank tended to tear in the case of deep drawing. Consequently, conventional paper containers obtained by drawing were of shallow bottom, which restricted their application.

The present invention was made in view of the technical background described above and achieves the following object.

SUMMARY OF THE INVENTION

An object of the present invention is to provide a paper container of deep bottom integrally formed from a single-sheet blank, and a method of manufacturing it.

In a method of manufacturing a paper container of deep bottom integrally formed from a single-sheet blank, a further object of the present invention is to provide a method of calculating the development plan of the paper container.

In order to achieve the above object of the present invention, a method of manufacturing a paper container is provided wherein a blank is obtained by cutting a single-sheet of raw-material paper to a prescribed shape and an annular rule line constituting a regular polygonal shape is formed in the middle of this blank and designated as the bottom face of the paper container. After this, divided faces on the outside of the peripheral wall face constituting the peripheral wall face of the paper container and inner pleated faces on the inside are formed on the outside of the annular rule line. The divided faces are of the same number as the number of corners of the bottom face, and are arranged to extend from each side of the annular rule line to the outside. The blank regions between the divided faces constitute the inner pleated faces, the inner wall faces being bisected by axes of symmetry extending dividing the inner pleated faces into two symmetrical portions from the corners of the annular rule line. After this, the inside edges of each divided face are brought together by folding the annular rule line while folding each inner pleated face in two along the axis of symmetry, and the region inside the annular rule line is made to constitute the bottom face by folding over the inner pleated faces on each divided face.

If the height of the paper container, the radius of the uppermost face of the paper container, the radius of the lowermost face of the paper container, and the number of corners of the bottom face of the paper container are determined, a paper container of any desired shape with an open upper surface can be produced. The condition of the paper at the rim of the uppermost face of the paper container can be made to be a single sheet, or three sheets, or, if appropriate, five sheets, at particular locations.

Next, embodiments of the present invention will be described.

DESCRIPTION OF THE PREFERRED EMBODIMENTS

First Embodiment

Examples of application of the present invention are described in detail below with reference to the drawings. First of all, an example of the present invention is described with reference to FIG. 1 to FIG. 5.

Construction of the Paper Container

Figure 1:
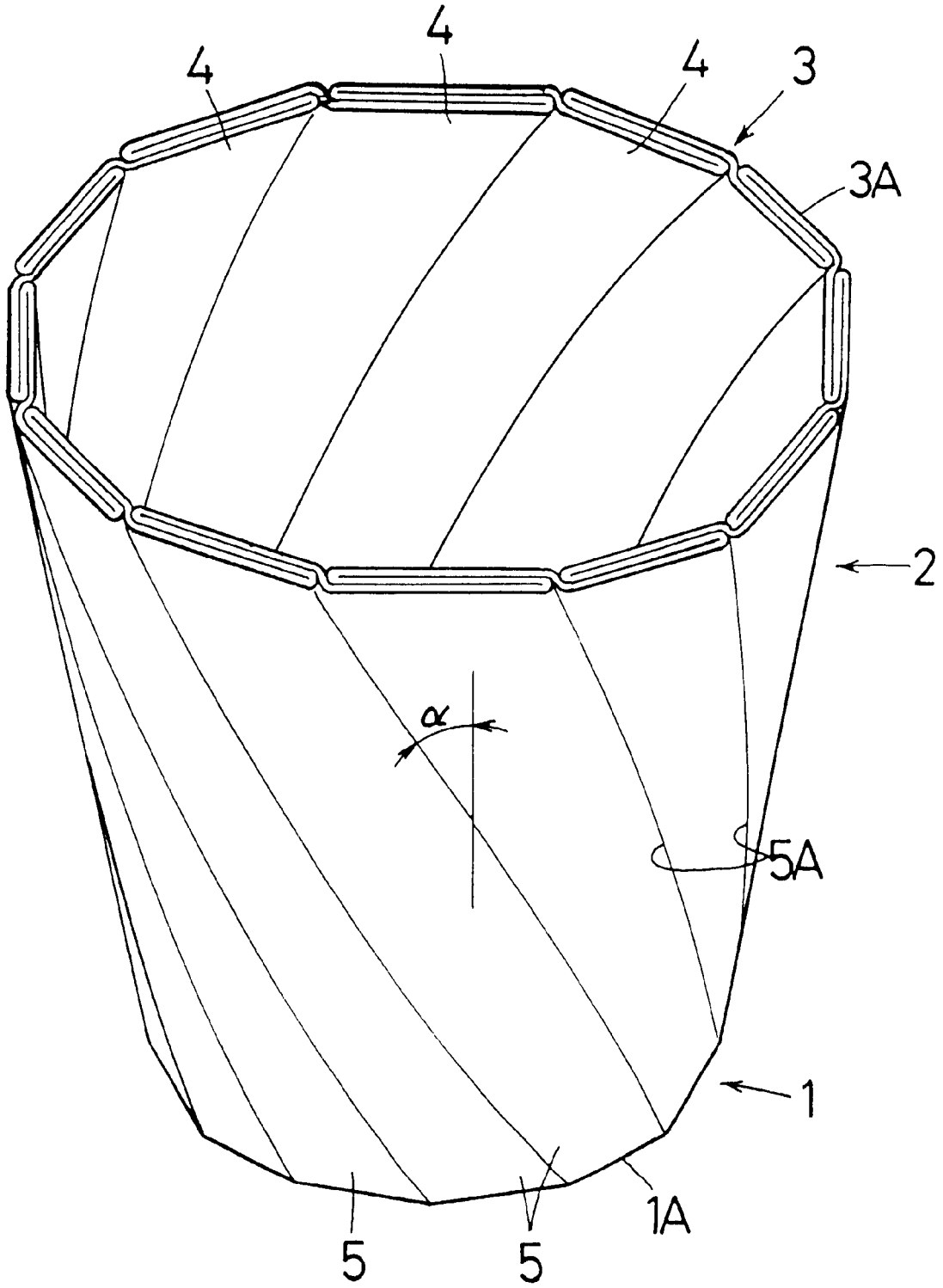
FIG. 1 is a perspective view illustrating a first embodiment of a paper container according to the present invention.
Figure 2:
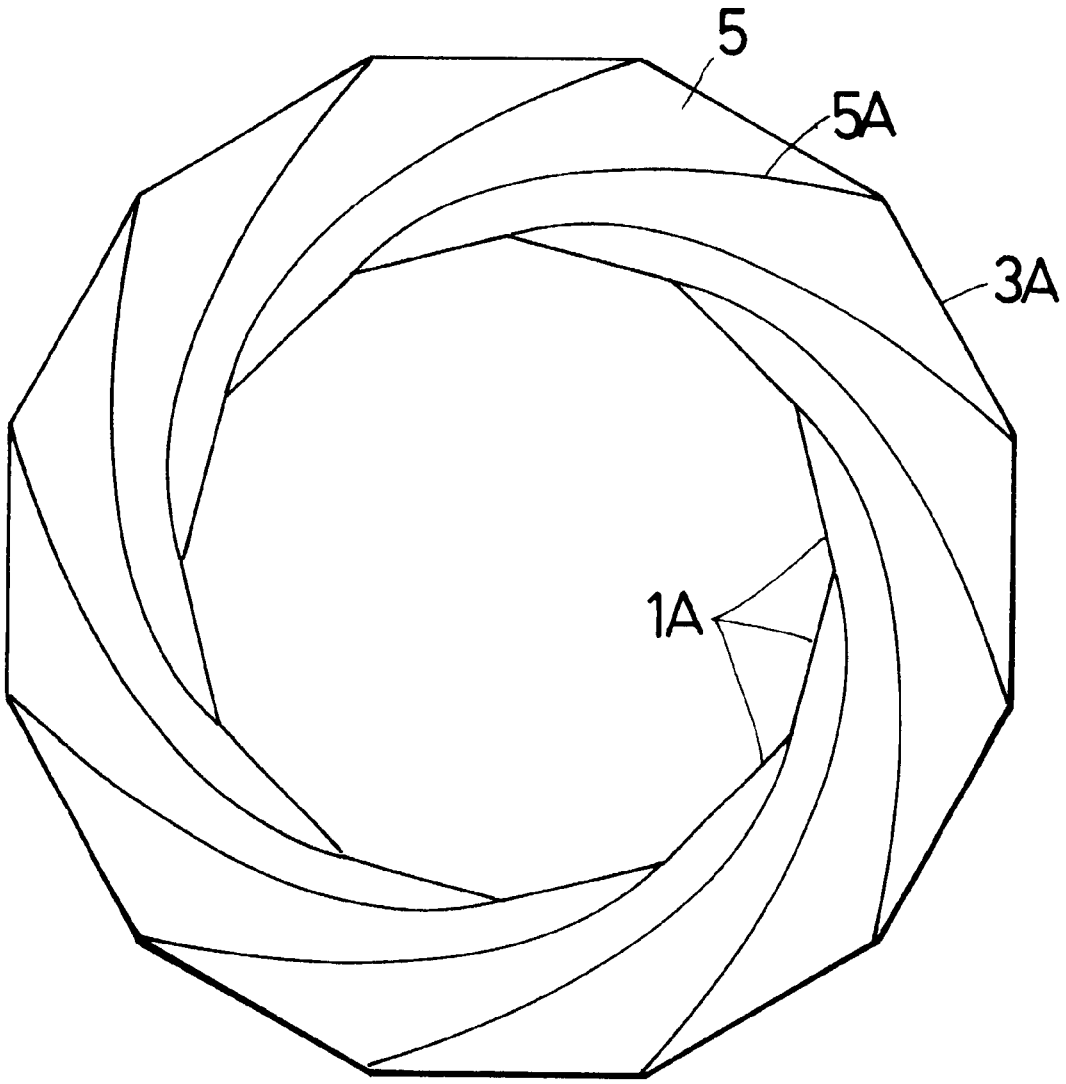
FIG. 2 is a bottom face view of the paper container of FIG. 1.

FIG. 1 is a perspective view showing an overall view of a Practical Example of a paper container. FIG. 2 shows a bottom face view of the same. This paper container is integrally formed in a tapered tubular shape widening to some degree in the upward direction by folding up a single-sheet blank. The paper container is constituted of a bottom face 1 and a peripheral wall 2, its upper face 3 being open. Oppositely to the paper container as shown in FIG. 1, it could also be constituted in an inverse tapered shape widening from upper face 3 to bottom face 1.

Although in the present embodiment bottom face 1 is constituted by a regular dodecagonal shape, in general it could be of circular shape or regular polygonal shape other than dodecagonal. Peripheral wall face 2 is constituted of a plurality of partitioned outside divided faces (portion constituting the outer wall face) 5 and inner pleated faces on the inner peripheral side (portion constituting the inside wall face) 4. As shown in FIG. 1, the divided faces 5 refer to the outer peripheral wall constituted of quadrilaterals, and inner pleated faces 4 refer to the portions where the sheet is folded and overlapped in two layers. Each divided face 5 stands erect with a prescribed gradient from the bottom face 1 towards the circumferential direction, and extends along the outer peripheral face of peripheral wall 2 as far as the upper face 3.

That is, the divided faces 5 are formed in strip shape (axially elongate shape) extending from the peripheral edge of bottom face 1 in helical fashion towards the edge 3A of the opening of the upper face; their side edges 5A are mutually brought up against each other so that the inner pleated faces 4 there between (portions where two sheets are overlapped) are arranged in linked fashion in the peripheral direction sandwiched between two divided faces 5. The inner pleated faces 4 are constituted by folding over two triangular shapes (see the development plan of FIG. 3).

Figure 3:
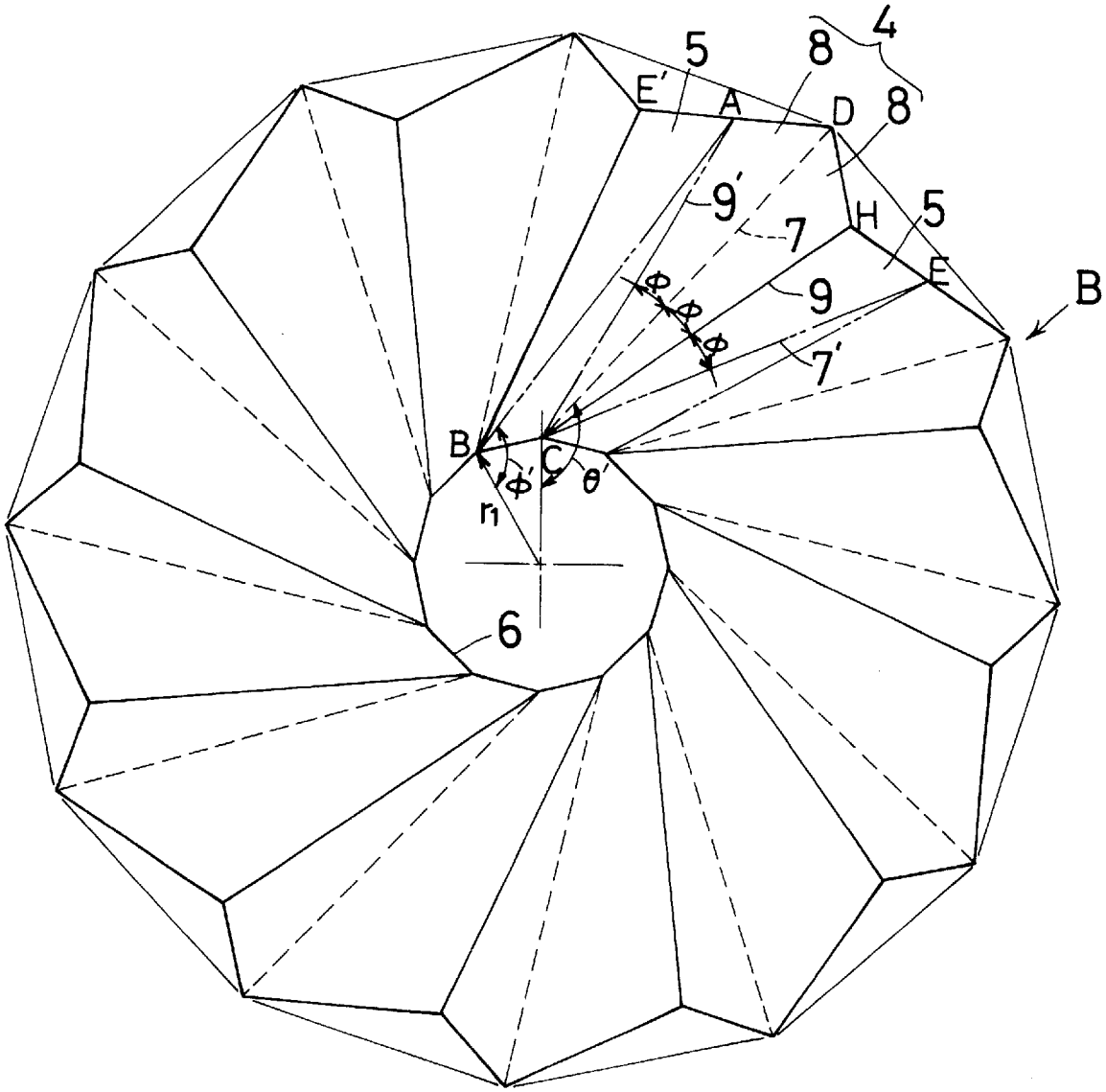
FIG. 3 is a development plan of the paper container of FIG. 1.

Furthermore, as is clear from FIG. 3, the inner pleated faces 4 are folded over on their inside faces along respective divided faces 5, being mutually interposed between divided faces 5 in triangular fashion, folded in two, with the vertices of the triangles touching a peripheral edge 1A of bottom face 1 (corner of the dodecagon). In a paper container constructed from a single sheet of paper in this way, the paper container can be maintained in fixed shape without employing any adhesive at all. A paper container constructed in this way can be employed as a blank for containers for food products or plant pots etc. by using coating paper formed with a covering film of synthetic resin film or other water-repellent material.

Development Plan

FIG. 3 shows this paper container in opened-out condition. In FIG. 3, the hill fold lines (rule lines 7) are indicated by broken lines and the valley fold lines (lines 9) are indicated by thin lines. Also, from this Figure, bottom face 1 is defined by annular rule line 6 forming a regular dodecagonal shape in the middle of blank B and branching rule lines, lines 9 and rule line 7 are provided extending in radial fashion from each corner of this annular rule line 6.

If the combination of a single divided face 5 and a single inner pleated face 4 is considered as the structural unit of a single peripheral wall face 2, the number of such structural units is equal to the number of corners of the bottom face. In the Figure, divided face 5 is the quadrilateral E'ACB, and inner pleated face 4 is the quadrilateral ADHC consisting of ΔADC and ΔDHC. The lead angle of the side faces 5A of divided faces 5 of the paper container is $\alpha$.

ΔADC and ΔDHC are hill-folded at rule line 7 and are valley-folded at line 9, and overlaid on ΔHEC of the adjacent divided face 5. The torsional angle of line AB and line DC is $\phi$. The lead angle $\alpha$ of side face 5A of divided face 5 is different from the torsional angle $\phi$. If line DC is a straight line, the torsional angle $\phi$ will be 0.

When the paper container is produced, the quadrilateral E'ACB appears as a divided face from outside the paper container and pleated face 4 (quadrilateral ADHC) is not visible. From within the paper container, quadrilateral ADCB is visible and ΔDHC and ΔHEC are not visible.

Also, as can be seen from the Figure, polygon BADHEC can be considered as the structural unit of the wall face of the paper container.

Inner pleated face 4 is constituted by the overlapping portion produced by a hill-folded line at rule line 7 centered thereon and produced by folding defining two triangles 8 with angle $\phi$. As is clear from FIG. 3, blank B constituting the paper container is defined by a regular dodecagon defining the bottom face 1 (annular rule line 6), and a larger-diameter regular dodecagon arranged concentrically therewith, its corners being linked with the corners of the regular dodecagon of the bottom face 1 by rule lines 7.

In the development plan, when the paper container is constructed by folding up along the hill fold lines and valley fold lines, the lines where rule line 7 and line 9 are superimposed are respectively indicated in the drawing as line 7' and line 9'.

Branching lines 9', 9 are straight lines drawn towards the larger diameter regular dodecagon with angle $\phi$ from the corners of the bottom face 1 on both sides of and centered on rule line 7. Inner pleated face 4 is the region on the inside of branching lines 9', 9. Consequently, the divided faces 5 are elongate quadrilaterals with one side constituted by each face of annular rule line 6 and extending with a certain angle to the radial direction, the inner pleated faces 4 (see FIG. 1) being formed mutually there between. Line 7' extends from a corner of the bottom face 1 while making an angle $\phi$ with line 9.

In FIG. 3, the angle made by the branching rule lines 7, 7' is shown as $2\phi$; by varying this angle $\phi$, the degree of opening of the upper face of the paper container obtained can be made larger or smaller. Clearly, also, as the angle $\theta'$ of the line 7 and the radial direction of the bottom face 1 approaches $\pi$, the tapering of the paper container becomes less.

Method of Manufacture

Figure 4:
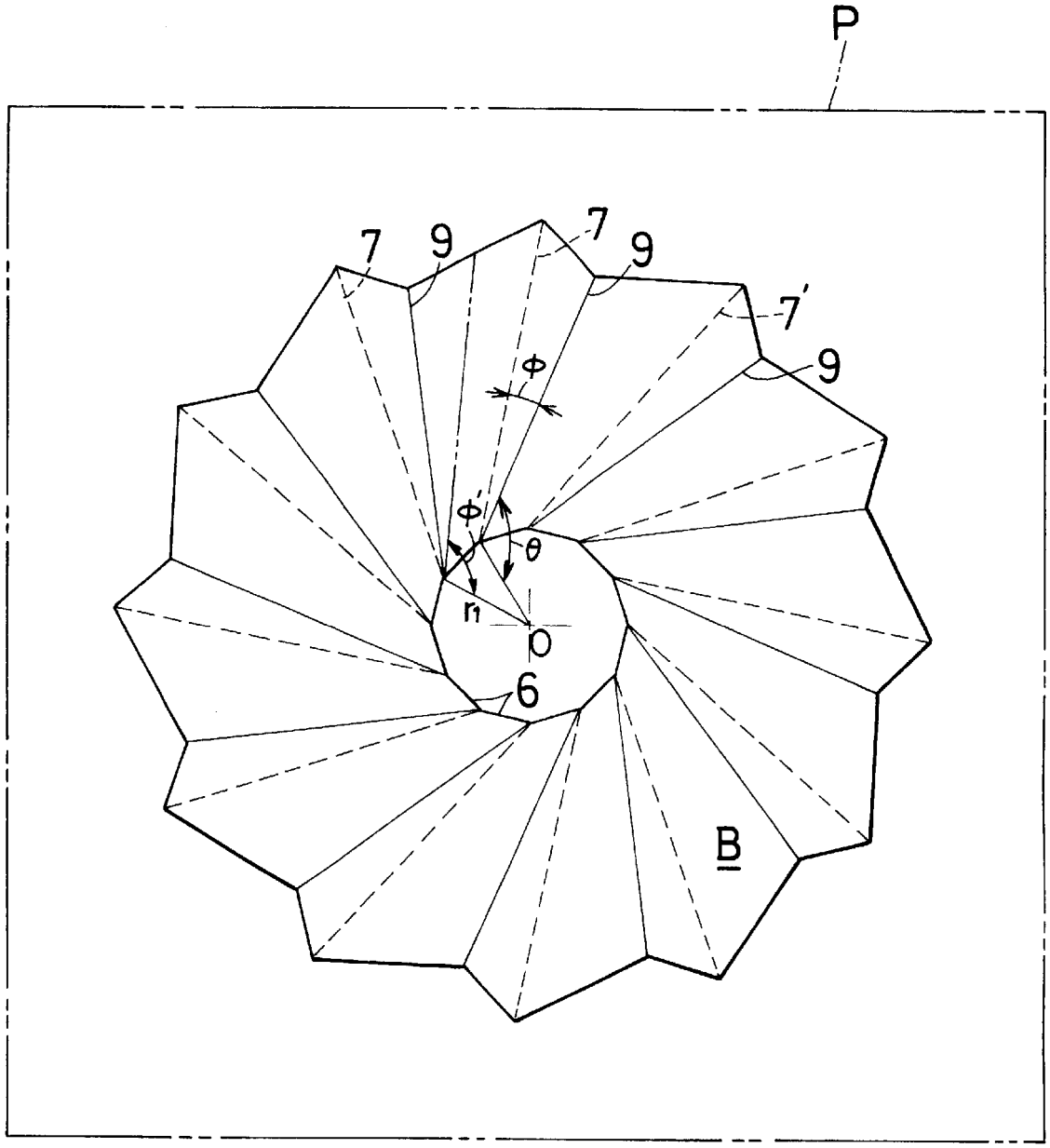
FIG. 4 is a plan view showing a condition in which a blank for molding the paper container of FIG. 1 is extracted from raw-material paper.
Figure 5:
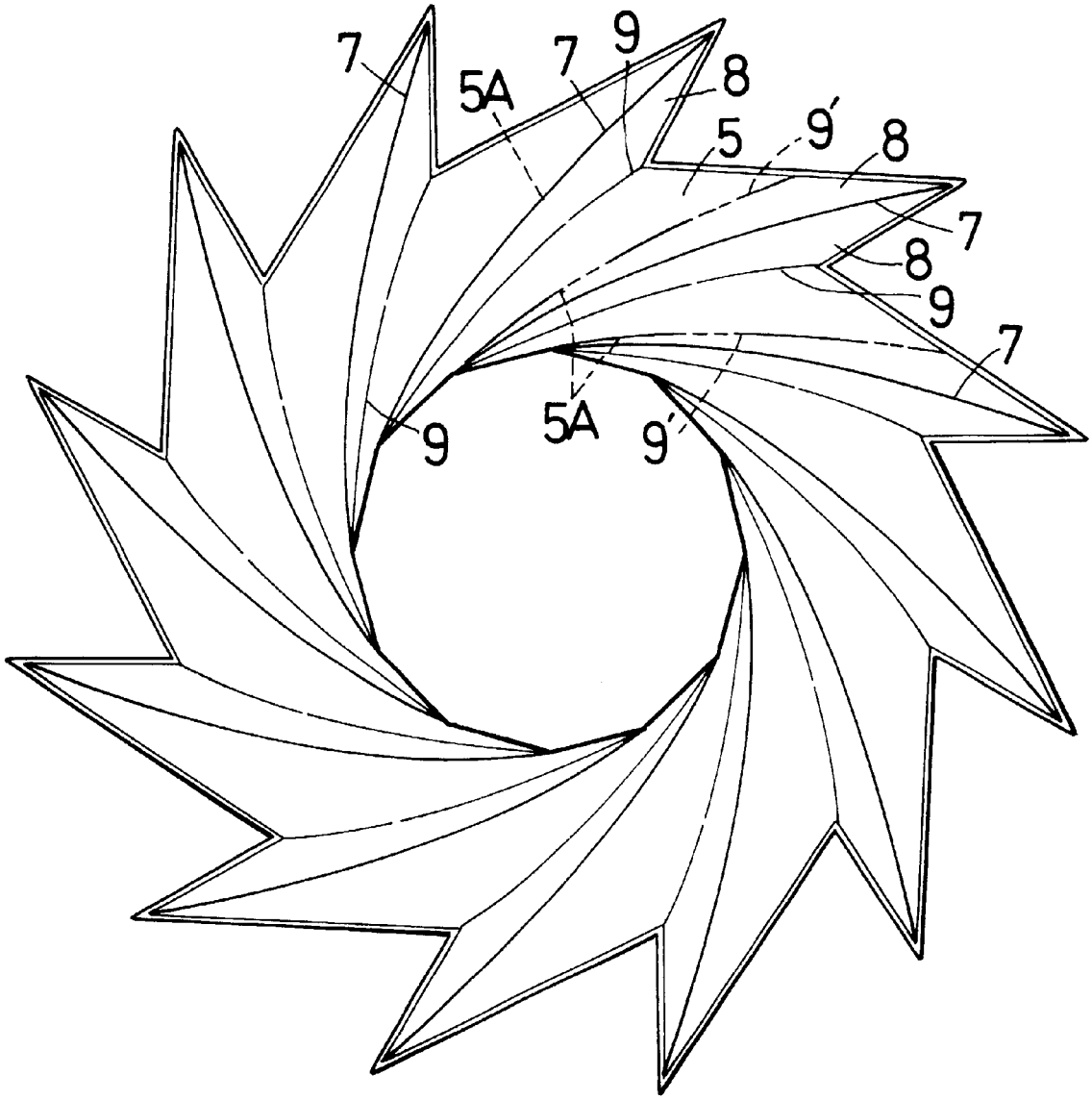
FIG. 5 is a view showing a condition in which the blank of FIG. 1 is folded up, and is a rear view as seen from FIG. 3.

A method of manufacturing a paper container constructed in this way will now be described with reference to FIG. 4 to FIG. 5. First of all, prescribed raw-material paper P is prepared as shown in FIG. 4, and this is converted into a blank B by cutting to a prescribed shape, in particular in this embodiment a regular dodecagonal shape, for example using a trimming die. In particular, by using a trimming die incorporating rule lines in addition to the cutting edges, blank B may be formed with an annular rule line 6 and lines 9 for constituting valley fold lines, as well as lines 7 for constituting hill fold lines, simultaneously with the molding thereof. Lines 7 are formed so as to extend making an angle $\theta'$ with the radial direction of the bottom face 1 and lines 9 are formed on one side thereof making an angle $\phi$ with rule lines 7. Annular rule line 6 is formed in the middle of blank B in the shape of a regular dodecagon.

In this way, inner pleated faces 4 are constituted as the regions of triangles 8 on both sides of rule lines 7 used as hill-folded lines; and inner pleated faces 4 and the strip shaped (rectangular) divided faces 5 formed mutually there between are alternately defined at the periphery of annular rule line 6. FIG. 5 is a plan view showing an intermediate condition in the production of a paper container by folding the blank of the development plan of FIG. 3, and is a rear view as seen from FIG. 3. As shown in FIG. 5, the side edges 5A (back faces of branching lines 9, 9') that define divided faces 5 are brought up against each other by folding the blank upwards along the upward-folding broken line 7 and folding downwards along the downward-folding thin line 9 so as to fold in two each of the inner pleated faces 4. The inner pleated faces 4, which are thus folded in two are thereby overlaid on the back faces i.e. the inner peripheral faces along the inner peripheral face side, of each of the divided faces 5.

A paper container as shown in FIG. 1 can thereby be obtained.

Also, a paper container of this type can be automatically molded (not shown) by coaxially arranging a cavity having ribs for effecting folding-in at rule lines 7 and a punch having grooves for receiving the inner pleated faces 4 which are folded in two. In particular, as a means for overlaying inner pleated faces 4 on divided faces 5, consideration may be given to indexed rotation of the punch following the helical shape of divided faces 5, with the cavity fixed.

The rim 3A of the aperture of the upper face of the paper container is made level (see FIG. 1) by making the peripheral edge of blank B flower petal shaped. The rim 3A of the upper face of the paper container shown in FIG. 1 may be left without any kind of processing or, as in this embodiment, the rim 3A of the upper face may be subjected to curling in which its outside is folded back to the inside. The possibility of the user of the paper container being injured by contact with the rim 3A of the aperture of the upper face is thereby reduced.

Also, the paper container can be prevented from being opened out even in the case where the taper angle is shallow (paper container of small height), by folding back, outwards or inwards by curling, the rim 3A of the aperture of the upper face of the paper container obtained. It should be noted that, although it is possible to maintain the paper container in fixed shape without using any adhesive at all since spreading out of the rim 3A of the aperture of the upper face is prevented by the fact that when the rim 3A of the aperture of the upper face is folded back outwards or inwards by for example curling a condition is maintained in which the inner pleated faces 4 are folded up along the divided faces 5, it would also be possible to stick the inner pleated faces 4 on to the divided faces 5 by using adhesive instead of folding in the rim 3A of the aperture of the upper face.

Also, the paper containers according to the present invention are not restricted to paper containers whose bottom face 1 is of regular dodecagonal shape as described above and bottom face 1, peripheral wall face 2 and upper face 3 could be made of substantially circular shape by further reducing the width of inner pleated faces 4 and divided faces 5, or these could be made of polygonal shape, such as triangular shape or quadrilateral or even twenty four gon shape, in particular, the regular polygons of these.

Method of Calculation

Figure 6:
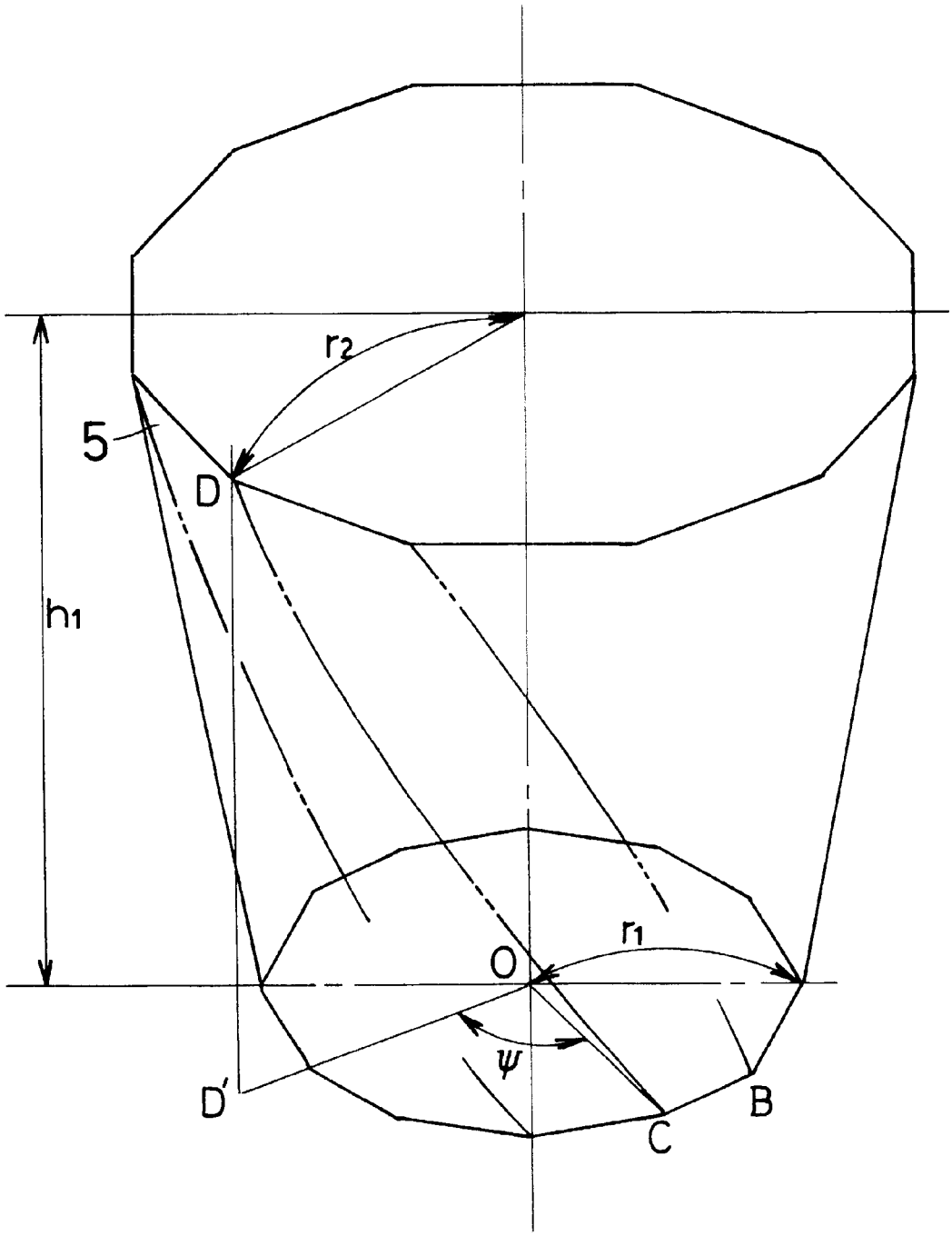
FIG. 6 is an overall view of a paper container according to a calculation example.

A method of determining and calculating the various necessary parameters for forming a paper container by the above steps will now be described. In general, in almost all cases, the height of the paper container and the radius of bottom face 1 and upper face 3 are given; in addition, the number of corners of bottom face 1 is often given. In some cases, as shown in FIG. 6, the lead angle $\alpha$ of the lateral side 5A of the divided face 5 or the torsional angle $\phi$ of the lateral sides AB. DC of quadrilateral ADCB seen from inside the paper container may be given.

Herein below, a method of determining torsional angle $\phi$ ($\theta'$ or $\theta$) and the length of the sides and angles of inner pleated faces 4 and divided faces 5 when the height $h_1$ of the paper container, radius $r_1$ of bottom face 1, radius $r_2$ of upper face 3 and bottom face 1 is given as a regular n-gon are given as initial conditions is described. A paper container molded in accordance with the parameters determined by a calculation as below was found to be fully satisfactory for manufacture as a paper container within the range of manufacturing error.

A method of calculating the various structural elements of the paper container will be described with reference to FIG. 3 and FIG. 6 to FIG. 8. In general, an development plan can be obtained if the radius $r_2$ of the upper face 3 of the paper container, the radius $r_1$ of its bottom face 1, the height $h_1$ of the paper container, the number of corners n of bottom face 1 and the torsional angle $\phi$ (are given.

FIG. 6 is an overall view of the paper container and FIG. 3 is a development plan thereof. The number of divided faces 5 of peripheral wall face 2 is the same as the number of sides of bottom face 1; overall, the paper container is formed so as to be tapered in helical fashion with an angle $\phi$. These divided faces 5 have an axially elongate quadrilateral shape (polygon E'ACB) from each side of regular dodecagonal bottom face 1 outwards in the radial direction in the development plan, FIG. 3. In the development plan, the region between one divided face 5 and another divided face 5 constitutes an inner pleated face 4 that is folded in two (quadrilateral ADHC (consisting of $\Delta$ADC and $\Delta$DHC); inner pleated face 4 is folded over along the hill-fold lines and valley-fold lines so as to overlie divided face 5.

To achieve this, it is necessary for $\angle$ HCD and $\angle$ ECH to be equal angles $\phi$. Also, when the paper container is produced, in order for the divided faces 5 and inner pleated faces 4 to overlap uniformly (in a triply overlapping condition seen from any part of the upper face of the aperture of the paper container), it is necessary that line sections E'A, AD, DH, and HE should respectively be equal. To achieve this, it is necessary that $\angle DCA=\angle HCD=\angle ECH=\phi$. Also, if the length of each side of the quadrilateral ADCB and ADHC and $\Delta$HEC, and each angle are found, a development plan of the paper container can be obtained, enabling the paper container to be produced.

The method of determination and calculation of the various parameters of the quadrilateral $\Delta$DCB and $\Delta$DHC and $\Delta$HEC that are necessary when manufacturing the paper container will now be described in detail. Since, if the bottom face one of the paper container is of polygonal shape and the number of corners n is sufficiently large, it can be approximated as a conical shape, it will be examined in terms of this form.

Figure 7:
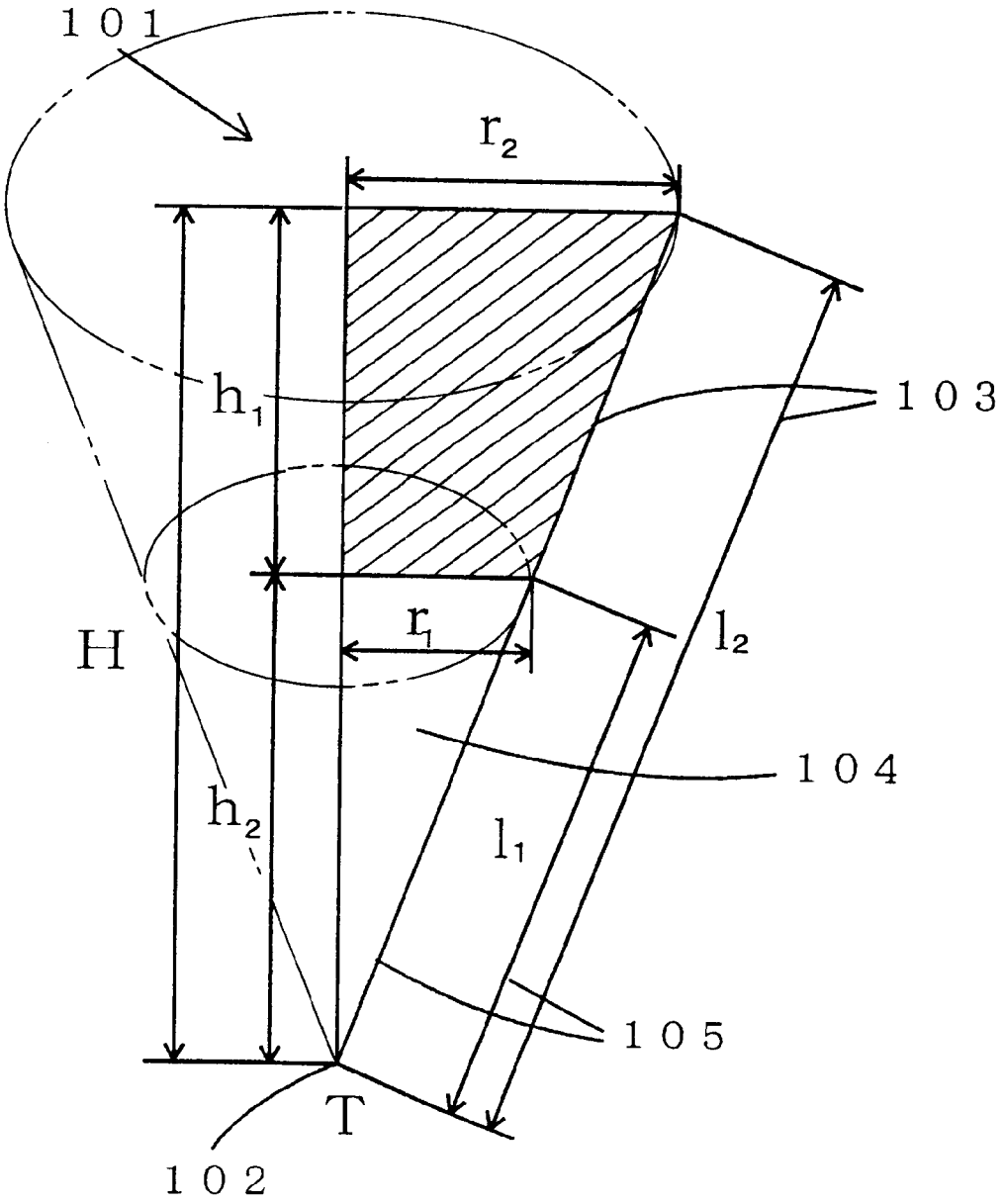
FIG. 7 is a front view of a circular cone used in the calculation.

Cutting is effected at a plane including the centerline of the paper container of centerline height $h_1$ that is to be manufactured. The line extending the generating line 103 represented at the cross-sectional plane when the cut is made and the line extending the centerline of the paper container intersect at T. That is, if the bottom part of the paper container is extended, it becomes a circular conical shape, the aforementioned cross-sectional plane being the shape obtained by cutting this. The vertex 102 when the peripheral wall 2 of the conical shape is extended in the direction of the bottom face 1 as shown in FIG. 7 to define a right circular cone 101 will be designated as T. The paper container according to the present invention may be described as a shape equal to that obtained by cutting this right circular cone 101 in a direction at right angles to a given axis.

Figure 8:
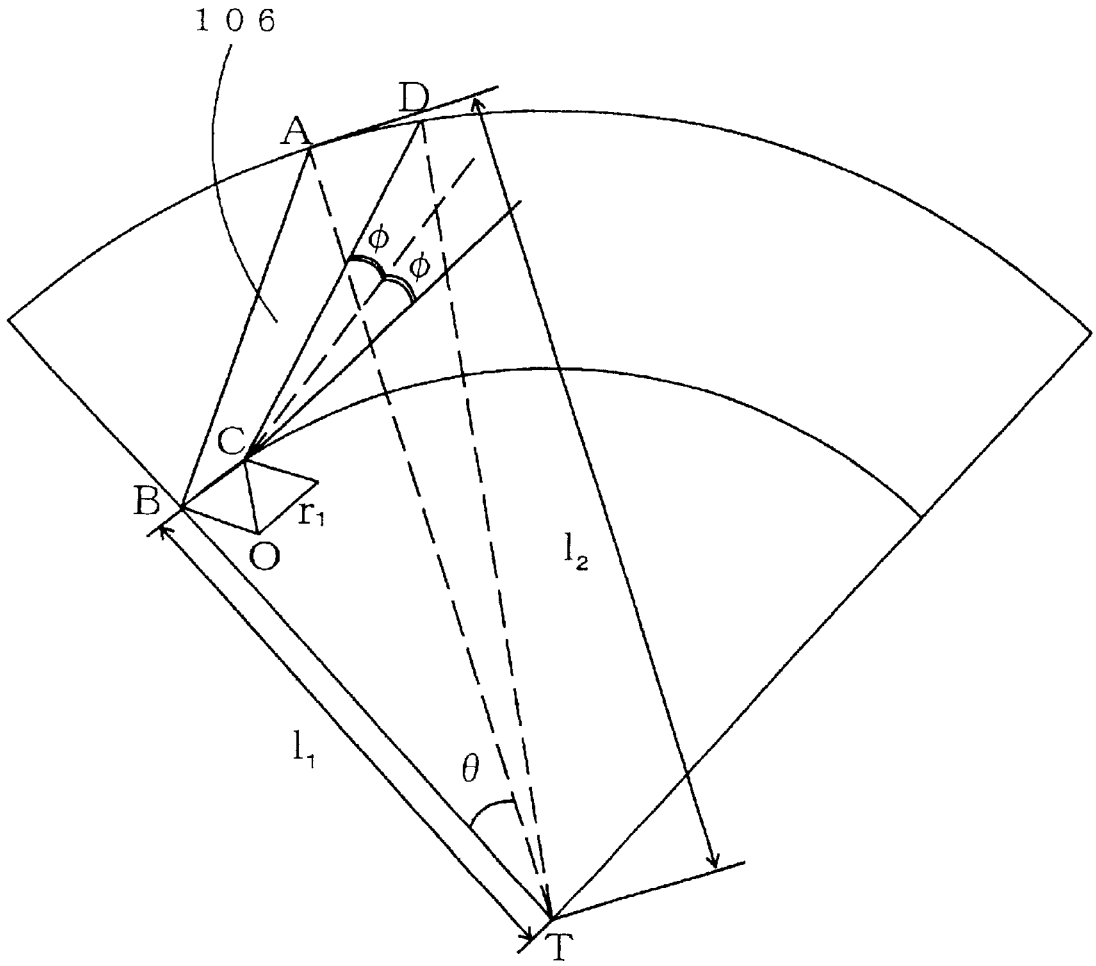
FIG. 8 is a development plan of the circular cone of FIG. 7.

FIG. 8 is a development plan of this circular cone 101. In FIG. 7, the height of the cone 101 defined by the upper face 3 of the container and vertex T is H, the length of generating line 103 is $l_2$, the height of cone 104 defined by bottom face 1 and vertex T is $h_2$, and that of generating line 105 is $l_1$.

Let ∠DAB of polygon ABCD 106 be ∠A, ∠B, ∠C, and ∠D being defined in like fashion. In order to create a development plan of the container from the initial parameters n, $r_1$, $r_2$, and $h_1$ (in the case of a uniform upper face 3), the lengths of each side and the angles and value ϕ of quadrilateral ADCB 106 are required.

Calculation of ϕ

Math 7

$$\angle B+\angle C+2\angle OBC+2\phi=2\pi$$

From the law of the internal angles of a quadrilateral and from ΔABT and ΔDCT of FIG. 8, Math 8

$$\phi=\angle TAD-\angle OBC=(\tfrac{1}{2}-r_2/nl_2)\pi-(\tfrac{1}{2}-1/n)\pi=(1-r_2/l_2)\pi/n$$

where

Math 9

$$l_2=TA=\sqrt{(H^2+r_2^2)}$$

$$H=h_1+h_2=h_1+r_1h_1/(r_2-r_1)$$

ϕ is therefore uniquely determined by n, $r_1$, $r_2$ and $h_1$.

Calculation of Sides

The lengths of the sides of quadrilateral ADCB 106 are calculated from the expressions given below.

Math 10

$$\text{arc } AD=2\pi r_2/n \quad (1)$$

$$AD=2l_2\sin(\pi r_2/nl_2) \quad (2)$$

$$\text{arc } BC=2\pi r_1/n \quad (3)$$

$$BC=2r_1\sin(\pi/n) \quad (4)$$

Length of hill-fold line 7 (side DC):

$$AB=CD=\sqrt{(l_1^2+l_2^2-2l_1l_2\cos\theta)} \quad (5)$$

where $\theta=\angle BTA=\phi r_2/l_2$

Calculation of Angles

Also, the angles of the quadrilateral ADCB 106 are calculated as follows:

Math 11

$$\angle A=\angle TAD+\angle TAB=\left(\frac{1}{2}-\frac{r2}{nl2}\right)\pi+\arccos\left(\frac{L^2+l_2^2-l_1^2}{2Ll_2}\right) \quad (1)$$

$$\angle B=\angle TBA-\angle TBC=\arccos\left(\frac{L^2+l_1^2-l_2^2}{2Ll_1}\right)-\arccos\left(\frac{r_1}{l_1}\sin\frac{\pi}{n}\right) \quad (2)$$

$$\angle D=\angle TAD-\angle TAB=\left(\frac{1}{2}-\frac{r2}{nl2}\right)\pi-\arccos\left(\frac{L^2+l_2^2-l_1^2}{2Ll_2}\right) \quad (3)$$

$$\angle C=2\pi-\angle A-\angle B-\angle D$$

where $L=AB=CD=\sqrt{(l_1^2+l_2^{2-2)}l_1l_2\cos\theta)}$ $\theta=\angle BTA=r_2\phi/l_2$ $\angle ATD=2\pi r_2/nl_2$ $\angle TAD=(\tfrac{1}{2}-r_2/nl_2)\pi$ $\angle TBC=\arccos((r_1/l_1)\sin(\pi/n))$ $\angle OBC=(\tfrac{1}{2}-1/n)\pi$ The angle between the radius $r_1$ of the regular polygon of bottom face 1 and AB is Math 12

$$\angle OBA=\phi'=\angle OBC+\angle B$$

As is clear from the above calculation, the development plan can be obtained if n, $r_1$, $r_2$, $h_1$ and θ or ϕ are given. Furthermore, ϕ is independent from ϕ, and if the values of $r_1$, $r_2$ and $h_1$ are given, a paper container of the same shape can be produced using a different value of ϕ. The condition of the paper at the rim of the uppermost face of the paper container can be made to be a single sheet, or three sheets, or, if appropriate, five sheets, at particular locations.

Calculation When the Edge Sides on the Upper Face Side of the Divided Faces Triply Overlap Also, when the condition that n, $r_1$, $r_2$, $h_1$ and the rim 3A of the aperture of the upper face triply overlap is inserted as an initial condition for the paper container, it is found to be necessary that $\angle ACD=\phi$ and $AC=HC$ The method of calculation in this case is indicated below. When equations are written for A, B, C and D, the following determinant is obtained. Putting $P_1=A$ $P_2=C$ $P_3=T$ $P_4=D$ $d_{ij}=P_iP_j$ and putting $AC=d_{12}=x$, $d_{13}=l_2$, Math 13 we have $$d_{14}=2l_2\sin(\pi r_2/nl_2)$$

$$d_{23}=l_1,\ d_{24}=L,$$

$$d_{34}=l_2.$$

Math 14

$$d_{24}=L=\sqrt{(l_1{}^{2+l_2{}^{2-2l_{\ldots}}}}$$

is a variable of θ.

Apart from $d_{12}$ and $d_{24}$, this is uniquely determined by n, $r_1$, $r_2$ and $h_1$.

The following determinant is obtained.

[Math 15]

$$M=\begin{pmatrix} 0 & d_{12}^2 & d_{13}^2 & d_{14}^2 & 1 \\ D_{12}^2 & 0 & d_{23}^2 & d_{24}^2 & 1 \\ d_{13}^2 & d_{23}^2 & 0 & d_{34}^2 & 1 \\ D_{14}^2 & d_{24}^2 & d_{34}^2 & 0 & 1 \\ 1 & 1 & 1 & 1 & 0 \end{pmatrix}$$

Since point A, point C, point T and point D are on the same plane, the determinant M is 0.

Therefore $$det(M)=0 \qquad \text{(equation C)}$$

The relationship expression for ∠ACD=ϕ is as follows:

Math 16

$$(L^2+x^2-AD^2)/2Lx=\cos\phi$$

$$[L^2+x^2-\{2l_2\sin(\pi r_2/nl_2)\}^2]/2Lx=\cos[[1-r_2/l_2](\pi/n)] \qquad \text{(equation D)}$$

which is an equation in the two variables x and θ.

θ can be obtained by solving the simultaneous equations: equation C and equation D.

From the value of θ, [Math 17]

$$\theta=\angle BTA=\phi r_2/l_2.$$

the value of ϕ scan also be found by the equation:

Also, the value ϕ can be found by directly, without going through θ, by rewriting the equation.

In this way, the length of AC can be calculated.

Example of Method of Constructing a Development Plan

First of all, a regular n-gon of radius $r_1$ defining the bottom face 1 is constructed, and n triangles are constructed linking each vertex thereof and the center point O of the polygonal shape of the bottom face 1. A quadrilateral ADCB is then constructed from these interior triangles in the radially outwards direction. In doing this, the angles and sides of ABCD obtained by calculation are utilized. The line CH making an angle ϕ therewith is constructed, and the polygon BADHC is thereby obtained.

The next polygon can be constructed by shifting this polygon BADHC through an angle 2 π/n about the center point O. By repeating this step, a development plan of the paper container is obtained and the paper container can be constructed by hill-folding and valley-folding along the respective lines. In order to obtain polygon BADHC, the length of AB, the length of AD, and the values of ϕ and ϕ' are necessary; these values are calculated by the above formulae from the initial conditions n, $r_1$, $r_2$, $h_1$.

Formation of the development plan is not restricted to using the sequential steps described above but could be achieved by any sequence using the calculated lengths of the various sides and of the various angles.

Second Embodiment

Figure 9:
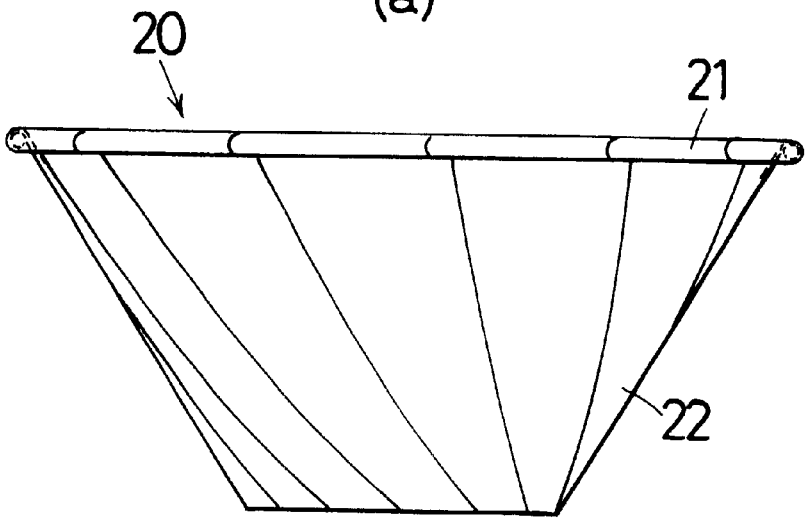
FIG. 9 is a view illustrating a second embodiment.
Figure 9:
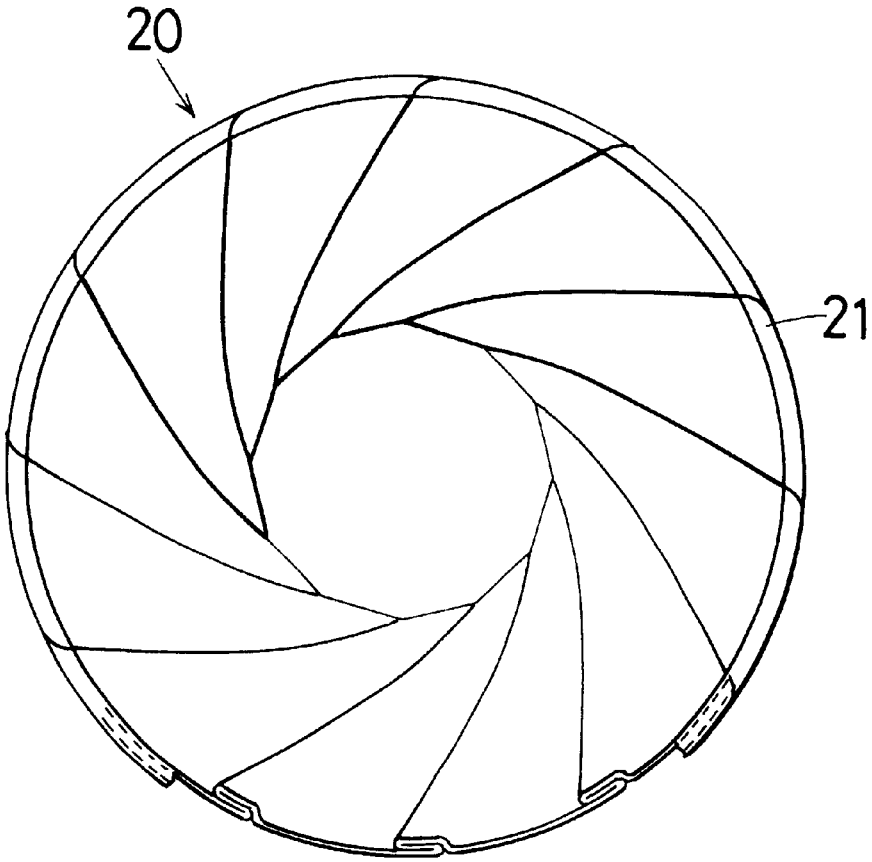

FIGS. 9(*a*) and (*b*) show a second embodiment of a paper container wherein curling is performed at the upper face, FIG. 9(*a*) being a plan view thereof and FIG. 9(*b*) being a plan view of FIG. 9(*a*) with part broken away. Opening out of the divided faces 22 of paper container 20 is prevented by curling 21 of the upper edge of paper container 20. If the lead angle α of the lateral sides 5A of the divided faces 5 described above or the torsional angle ϕ of the lateral sides AB and CD of the quadrilateral ADCB seen from within the paper container are comparatively large, a paper container can be constructed wherein the divided faces 22 are not easily opened out.

As can be seen from FIG. 9(*b*), only part of the rim of divided faces 22 on the upper face side of paper container 20 constitutes a blank which is triply overlaid. In this embodiment, curling 21 is performed in order to prevent opening out of the rim of the divided faces on the upper face side. However, it is possible to construct a paper container 20 in which the divided faces 22 are opened out without applying curling to the rim of divided faces 22 of paper container 20 on the upper face side.

As is clear from the above description, with the present invention, a single blank can be formed in tubular shape, leaving its middle part intact, by forming pleats by gusset folding of the periphery thereof, so a paper container with a deep bottom can easily be constructed without damaging the blank; thus a distinction can be achieved over conventional plastic containers.

Also, since this paper container can be formed with a deep bottom, its possible applications are expanded; in particular, since it is integrally molded from a single blank, by employing coated paper for the blank, in contrast to paper containers obtained by the paper-making method, it can be given waterproof properties such as make possible its application even to drinks containers. Furthermore, since it has inner pleated faces that are folded up in the peripheral face, it has high strength and good appearance. Moreover, the fixed shape can be maintained without use of adhesive, by subjecting the rim of the upper face aperture to curling.

What is claimed is:

1. A paper container which is integrally formed from a single-sheet blank and the upper face of which is open, said paper container comprising:

a polygonal bottom face; and a peripheral wall face consisting of a plurality of outside divided faces of quadrilateral shape which are helically wound and of inner pleated faces consisting of two triangles constituting an inner wall face by being folded in two on the inside and continuously overlaid;

wherein, in a development plan of said paper container, the bottom face is positioned at the center of the single-sheet blank;

said divided faces and said inner pleated faces are provided at the periphery of said bottom face in a number equal to the number of sides of said bottom face;

said divided faces and said inner pleated faces are positioned alternately and extend in linear fashion from the peripheral edge of said bottom face towards the outside in the radial direction;

a blank portion between one of said divided faces and another of said divided faces constitutes one of said inner pleated faces, a vertex of the blank portion is a corner vertex of said bottom face;

said inner pleated face consists of two triangles having a common vertex with a corner of said bottom face and a common side which is an axis of symmetry; and each of said inner pleated faces are overlapped on the inside of one of said divided faces by folding up on said axes of symmetry.

2. A method of manufacturing a paper container which is integrally formed from a single-sheet blank, an upper face of the paper container being open, said paper container comprising a polygonal bottom face, and a peripheral wall face consisting of a plurality of outside divided faces of quadrilateral shape which are helically wound and of inner pleated faces consisting of two triangles constituting an inner wall face by being folded in two on the inside and continuously overlaid, wherein, in a development plan of said paper container, said bottom face is positioned at the center of the single-sheet blank;

said divided faces and said inner pleated faces are provided at the periphery of said bottom face in a number equal to the number of sides of said bottom face;

said divided faces and said inner pleated faces are positioned alternately and extend in linear fashion from the peripheral edge of said bottom face towards the outside in the radial direction;

a blank portion between one of said divided faces and another of said divided faces constitutes one of said inner pleated faces, a vertex of the blank portion is a corner vertex of said bottom face;

each of said inner pleated faces consists of two triangles having a common vertex with a corner of said bottom face and a common side which is an axis of symmetry; and said method comprising folding up each of said inner pleated to thereby manufacture said paper container.

3. A method of manufacturing a paper container which is integrally formed from a single-sheet blank, an upper face of the paper container being open, said paper container comprising a polygonal bottom face, and a peripheral wall face consisting of a plurality of outside divided faces of quadrilateral shape which are helically wound and of inner pleated faces consisting of two triangles constituting an inner wall face by being folded in two on the inside and continuously overlaid, wherein, in a development plan of said paper container, said bottom face is positioned at the center of the single-sheet blank;

said divided faces and said inner pleated faces are provided at the periphery of said bottom face in a number equal to the number of sides of said bottom face;

said divided faces and said inner pleated faces are positioned alternately and extend in linear fashion from the peripheral edge of said bottom face towards the outside in the radial direction;

a blank portion between one of said divided faces and another of said divided faces constitutes one of said inner pleated faces, a vertex of the blank portion is a corner vertex of said bottom face;

each of said inner pleated faces consists of two triangles having a common vertex with a corner of said bottom face and a common side which is an axis of symmetry; and the angle $\phi$ of the common vertex of said two triangles and the sides of said divided face are respectively calculated by the following formulae:

calculation formulae:

Math 1

$$\phi=[1-r_2/l_2](\pi/n)$$

$$l_2=\sqrt{(H^2+r_2^2)}$$

$$H=h_1+h_2=h_1+r_1h_1/(r_2-r_1)$$

$$l_1=\sqrt{(h_2^2+r_1^2)}$$

$$|\text{length of side on upper face side of divided face}|=2l_2\sin(\pi r_2/\text{nl}_2)$$

$$|\text{length of side on bottom face side of divided face}|=2r_1\sin(\pi/n)$$

$$|\text{length of lateral side of divided face}|=\sqrt{(l_1^2+l_2^2-2l_1l_2\cos\theta)}$$

where $\theta=\psi r_2/l_2$, $h_2=r_1h_1/r_2-r_1$ when $h_1$ is the height of the paper container, $r_2$ is the radius of upper face, $r_1$ is the radius of bottom face, n is the number of corners of bottom face.

4. The method of manufacturing a paper container according to claim 2 or claim 3, wherein an edge side on the side of said upper face of said divided face is calculated by the following formulae in order to achieve triple overlap:

calculation when there is triple overlaps of the edge sides on the upper face side where $h_1$ is the height of the paper container, $r_2$ is the radius of upper face, $r_1$ is the radius of the bottom face, n is the number of corners of bottom face, quadrilateral E'ACB is divided face, E'B and AC are the lateral sides of divided face, E'A is the edge side on the side of upper face of divided face, BC is the edge side on the side of bottom face of the divided face, polygon ADHECB is the structural unit of the peripheral face constituting the paper container, wherein a development plan of the paper container is constructed from bottom face and n polygons ADHECB around said bottom face, $\psi$ is the torsional angle of line AB and line DC, $\angle ACD=\psi$ is half of the angle $2\psi$ of the inner pleated face extending from a corner of the bottom face, and T is the vertex (T) when the bottom face side of the paper container is extended to be developed as cone (101);

condition for triple overlap:

assuming $\angle ACD=\phi$, AC=HC and that the vertices of the divided side and T are:

$$P_1=A$$

$$P_2=C$$

$$P_3=T$$

$$P_4=D$$

then $d_{ij}=P_iP_j$ $$AC=d_{12}=x$$

$$d_{13}=l_2,$$

Math 2

$$d_{14}=2l_2\sin(\pi r_2/nl_2)$$

$$d_{23}=l_1,\ d_{24}=L,$$

$$d_{34}=l_2.$$

Math 3 where $$L=\sqrt{(l_1^2+l_2^2-2l_1l_2\cos)}$$

and apart from $d_{12}$ and $d_{24}$, this is uniquely determined by n, $r_1$, $r_2$ and $h_1$;

writing the equations, the following matrix is obtained:

Math 4 Math 15

$$M=\begin{pmatrix} 0 & d_{12}^2 & d_{13}^2 & d_{14}^2 & 1 \\ D_{12}^2 & 0 & d_{23}^2 & d_{24}^2 & 1 \\ d_{13}^2 & d_{23}^2 & 0 & d_{34}^2 & 1 \\ D_{14}^2 & d_{24}^2 & d_{34}^2 & 0 & 1 \\ 1 & 1 & 1 & 1 & 0 \end{pmatrix}$$

since point A, point C, point T and point D are on the same plane, the determinant M is 0;

therefore $$det(M)=0 \qquad \text{(equation A)}$$

the relationship expression for ∠ACD=ϕ is as follows:

Math 5

$$(L^2+x^2-AD^2)/2Lx=\cos\phi/2Lx=\cos(\pi/n) \qquad \text{(equation B)}$$

which is an equation in the two variables x and θ;

θ can be obtained by solving the simultaneous equations:

equation A and equation B;

from the value of θ,

Math 6

$$\theta=\angle BTA=\psi r_2/l_2$$

the value of ψ can also be found by the equation:

and the value of ψ can be obtained by directly writing the equation without going via θ; and the length of AC can be calculated and the development plan of the paper container uniquely found.

5. The method of manufacturing a paper container according to claim 2 or claim 3, wherein the aperture rim of said upper face is produced by curling.

* * * * *